United States Patent [19]

Baker et al.

[11] 4,345,653

[45] Aug. 24, 1982

[54] PACKER DEFLATE SUBASSEMBLY FOR AN INFLATABLE PACKER SYSTEM

[75] Inventors: Randy S. Baker, Long Beach; Gerald C. Eckmann, La Puente, both of Calif.

[73] Assignee: BJ-Hughes Inc., Long Beach, Calif.

[21] Appl. No.: 121,960

[22] Filed: Feb. 15, 1980

[51] Int. Cl.[3] ..... E21B 33/127

[52] U.S. Cl. ..... 166/317; 166/334; 166/187

[58] Field of Search ..... 166/317, 332, 319, 334, 166/321, 187; 137/68 R; 285/2, 3, 4

[56] References Cited

U.S. PATENT DOCUMENTS

| | | | |
|---|---|---|---|
| 1,814,800 | 7/1931 | Heeter | 285/2 |
| 1,883,467 | 10/1932 | Banks | 285/2 |
| 4,050,512 | 9/1977 | Giebeler | 166/334 |
| 4,063,593 | 12/1977 | Jessup | 166/317 |
| 4,076,083 | 2/1978 | Sizer | 166/317 |

*Primary Examiner*—James A. Leppink

*Attorney, Agent, or Firm*—Robert A. Felsman

[57] ABSTRACT

An emergency deflation tool intended for use in an inflatable packer system. The mechanism comprises a cylindrical axially extending member adapted to be fixed against axial movement, another hollow cylindrical member surrounding a portion of the length of said member with a vent through the wall thereof, an inflation fluid passageway, and an expendable tension sleeve joining the two members.

7 Claims, 3 Drawing Figures

PACKER DEFLATE SUBASSEMBLY FOR AN INFLATABLE PACKER SYSTEM

CROSS-REFERENCE TO RELATED APPLICATIONS

U.S. patent application Ser. No. 120,418, filed Feb. 11, 1980, for an Inflatable Packer System by Felix Kuus.

BACKGROUND OF THE INVENTION

1. Field of the Invention

The present invention is intended for use in the "Inflatable Packer System" described in U.S. patent application Ser. No. 120,418, filed Feb. 11, 1980, by Felix Kuus. In The Inflatable Packer System, which is part of a well testing tool, the inflation/deflation cycle of the packer element(s) is ordinarily controlled by a sliding sleeve in the valve subassembly.

However, in the event that the sliding sleeve fails to function on the deflate cycle, a fail safe back-up is needed to insure that the packer(s) can be deflated and the entire tool retrieved. Inability to deflate the packer(s) would result in extreme difficulty and expense in retrieving a tool.

2. Prior Art

Various hydraulically set packer systems are set forth in the prior art that utilize an upward pull on the drill string to which they are attached to shear pins, which allows packer deflation. Systems which use the aforementioned shear pins are described in U.S. Pat. Nos. 3,391,740; 3,391,826; and 3,398,795.

However, experience has shown that shear pins that shear uniformly under a precise, predetermined tension are difficult to design and manufacture.

SUMMARY OF THE INVENTION

The invention comprises a deflate tool that is activated by pulling on the drill pipe to which it is ultimately attached. The pulling causes an expendable tension sleeve to break at a predetermined tension value, thereby allowing the packer element(s) to deflate. The tension value is precisely determined by specifying the depth of a groove in the tension sleeve.

DETAILED DESCRIPTION

Packer Deflate Subassembly 110

Figure 1A:
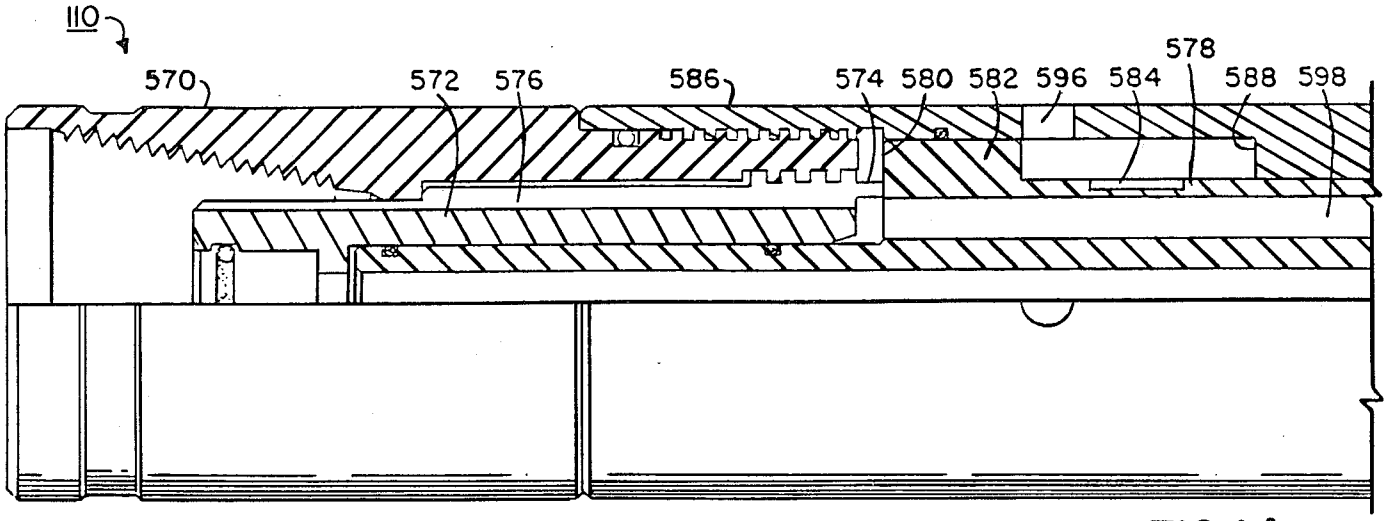
FIGS. 1A–1C illustrate the deflate tool in detail in partial cross section.
Figure 1C:
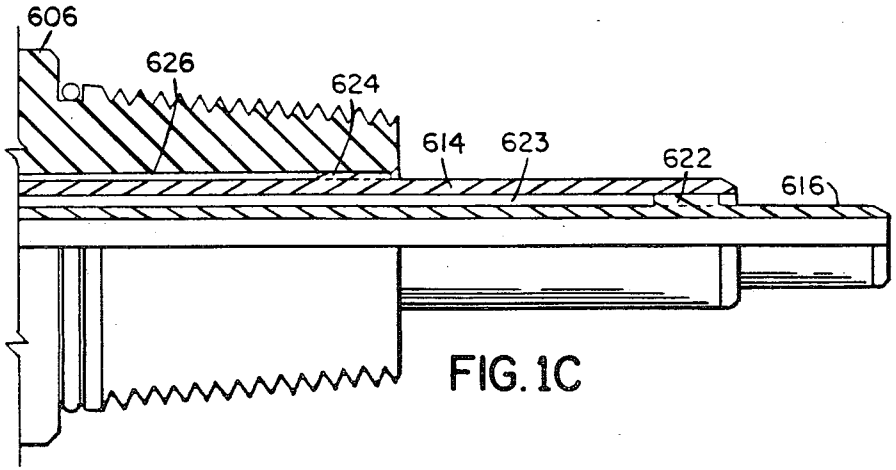
Figure 1B:
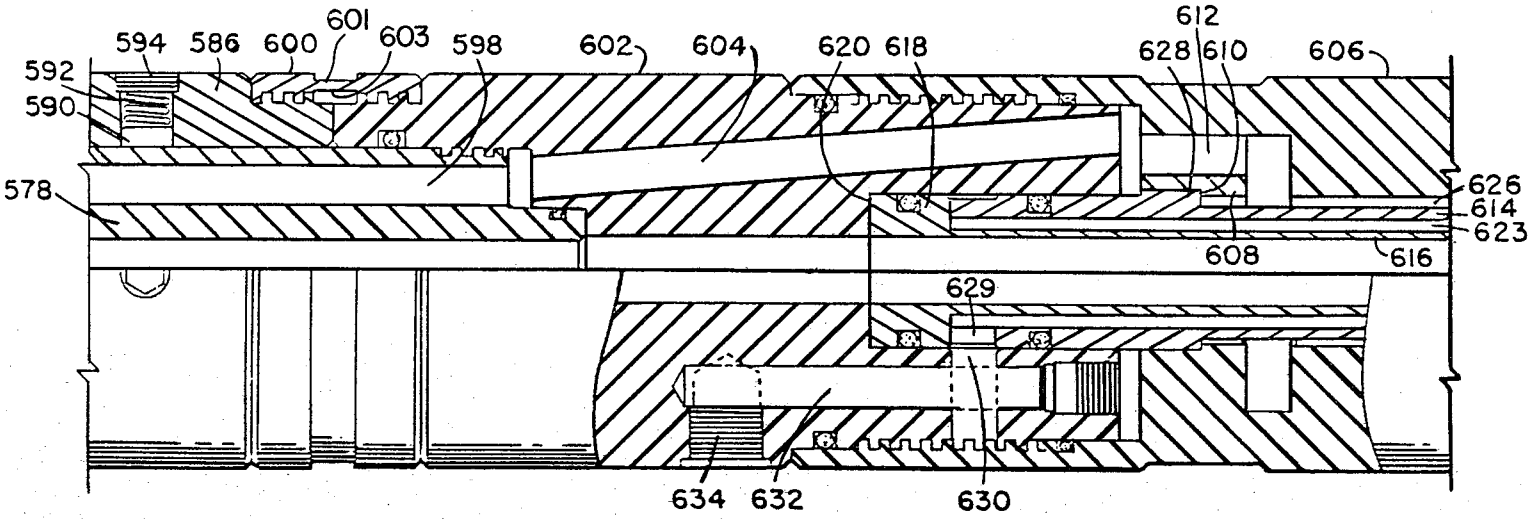

The preferred embodiment of the packer deflate subassembly 110 is set forth in detail in FIGS. 1A–1C. Hollow top sub 570 of the packer 10 deflate subassembly 110 is internally threaded near its 11 upper end to engage the bottom end of an adjacent subassembly (not shown). The top sub 570 13 is also internally and externally threaded near its 14 lower end.

The top sub 570 may surround and threadedly engage a stinger adapter 572 which is externally threaded near the lower end thereof. The stinger adapter 572 preferably terminates near its lower end in a projection 574 which may serve as a spacer. The stinger adapter 572 also may have longitudinal inflation channels in the outer surface as at 576, running from top to bottom thereof.

When a testing tool is made up and the top sub 570 of the packer deflate sub assembly 110 is threaded onto the lower end of bottom sub 546 of the valve assembly 108, the bottom end of adapter 560 of the valve assembly 108 may fit within the upper end of stinger adapter 572. A conventional O-ring carried by the stinger adapter 572 may provides a seal therebetween.

A portion of the length of the stinger adapter 572 may surround the upper length of a top connector 578 which is externally threaded near its lower end (FIG. 1B). Conventional O-ring may be carried by the top connector 578 to provide a seal between the stinger adapter 572 and the top connector near the upper and lower ends of the length common to both.

The outer diameter of the portion of the top connector 578 surrounded by stinger adapter 572 may be of a reduced diameter and terminate at a radial shoulder 580. Shoulder 580 is the upper face on a collar 582 about midway along the length of the top connector 578. The outer diameter of the top connector 578 below collar 582 may also be reduced in diameter and a detent 584 formed in the outer circumference a short distance below the collar 582.

When the packer deflate subassembly 110 is made up, projection 574 on the lower end of stinger adapter 572 preferably abuts the shoulder 580 on top connector 578. This provides a space between the two elements for the flow of inflation fluid.

A retrieving sleeve 586, internally threaded near its upper end, may threadedly engage the lower end of top sub 570. A conventional O-ring may be carried by the retrieving sleeve 586 to provide a seal between it and top sub 570. The retrieving sleeve surrounds the top connector 578 and bears against the collar 582. A conventional O-ring may be carried by the retrieving sleeve to provide a seal between it and collar 582.

The inner diameter of a portion of the upper length of 24 retrieving sleeve 586 may be enlarged and terminate in an upwardly facing radial shoulder 588. The inner diameter of the remaining length of the retrieving sleeve, below shoulder 588 may bear against the outer surface of top connector 578.

Four apertures may be formed to extend through the wall of the retrieving sleeve 586 below collar 582, as shown in FIG. 5B, and threaded near the radially outer ends thereof. The apertures are preferably spaced equidistant about the retrieving sleeve 586 and are each adapted to receive a dog 590, spring 592, and threaded plug 594. Dog 590 is preferably shaped so that the upper portion thereof forms a stem which is surrounded by spring 592. The spring 592 is compressed between the plug 594 and the lower portion of dog 590 and acts to force the dog 590 inwardly against the outer surface of top connector 578.

Four deflate ports 596, preferably spaced equidistant about the retrieving sleeve 586, may also be formed through the wall of the retrieving sleeve. They are preferably located just below collar 582 on top connector 578. In addition, fluid passageways 598 extending downwardly from shoulder 580 may be formed in the wall of top connector 578 to extend to a location near the bottom end thereof.

The top connector 578 may be externally threaded near its lower end and a circumferentially grooved tension sleeve 600, having an external circumferential groove 601 and an internal circumferential groove 603 and internally threaded near its upper and lower ends, may be attached thereto. The lower end of tension sleeve 600 may be threaded onto the externally threaded upper end of a middle connector 602. The middle connector 602 is preferably internally threaded near its upper end to threadedly engage the bottom end of top connector 578. An unthreaded extension of middle connector 602 may surround a portion of the outer surface of the top connector 578. A conventional O-ring may be used to provide a seal therebetween. The middle connector 602 may also surround the lower end of top connector 578 and an O-ring may provide a seal therebetween.

Longitudinally extending fluid passageways 604 may be formed in the wall of middle connector 602. The fluid passageways 604 preferably are located so as to be in communication with passageways 598 in top connector 578 and extend to the bottom end of connector 602.

Middle connector 602 may be externally threaded near its bottom end as shown. A bottom connector 606, internally threaded near its upper end may threadedly engage the lower end of middle connector 602. Conventional O-rings carried by the connectors 602 and 606, above and below the common threaded portion, may be used to provide a seal between the middle connector 602 and bottom connector 606.

Bottom connector 606 may be externally tapered and threaded near its bottom end and an O-ring carried near the upper termination of the threads (FIG. 1C). An inwardly depending, radial collar 608 (FIG. 1B) may also be formed on the internal diameter of the bottom connector 606, about midway along the length thereof. A portion of the length of the collar 608 may be radially altered to provide an upwardly facing shoulder 610. Axially extending fluid passageways 612 may also be formed through the collar 608.

The internal diameter of the lower length of middle connector 602 is preferably enlarged to receive the upper end of an outer stinger 614 and an inner stinger 616. The upper end of inner stinger 616 may terminate in an external collar 618, so that the upper face of the collar may abut a downwardly facing shoulder 620 formed by the upper termination of the enlarged inner diameter at the lower end of middle connector 602. A conventional O-ring may be carried by collar 618 to provide a seal between it and the inner diameter of middle connector 602. Outer stinger 614 surrounds inner stinger 616 and the upper end thereof may abut the lower face of collar 618. The inner stinger 616 is preferably spaced from outer stinger 614 by means such as a spider 622 located near the bottom end of the inner stinger. The spacing provides a by-pass fluid passageway 623 between the inner diameter of outer stinger 614 and the outer diameter of inner stinger 616. The upper end portion of inner stinger 616 is surrounded by the lower end of middle connector 602 and a conventional O-ring may provide a seal therebetween.

The lower portion of bottom connector 606 preferably surrounds outer stinger 614 and is spaced therefrom by means such as a spider 624 which may be integral with stinger 614. The spacing provides for an inflation fluid passageway 626 between the inner diameter of bottom connector 606 and the outer diameter of outer stinger 614.

A collar 628 may be formed on the outer diameter of outer stinger 614 near the upper end thereof. When the bottom connector 606 is connected to middle connector 602, the upper face of shoulder 610 on collar 608 of bottom connector 606 will bear against the lower face of collar 628 on the outer stinger 614. This forces outer stinger 614 and, in turn, inner stinger 616 upwardly until the upper face of collar 618 of inner stinger 616 abuts shoulder 620 on middle connector 602.

The upper end of by-pass fluid passageway 623 preferably terminates in slots 629 formed in the wall of inner stinger 616 (FIG. 1B). The by-pass slots 629 are in fluid communication with by-pass ports 630 formed in the wall at the lower end of middle connector 602. Axially extending, short, by-pass passageways 632 may be formed in the wall of the middle connector 602 from the lower end thereof to intersect by-pass ports 630. By-pass passageways 632 may terminate at their upper ends in by-pass orifices 634 formed in the wall of middle connector 602.

The lower ends of the by-pass passageways 632 may be tapped and plugged with conventional pipe plugs. The by-pass orifices 634 may also be tapped and threaded so that they may be plugged with conventional pipe plugs when only one packer is used.

Packer Deflate Subassembly 110 Operation

Ordinarily, the packer deflation function in a testing tool is carried out by a furnished valve subassembly. However, if the valve subassembly fails to function on the deflate cycle, the packer deflate subassembly 110 provides a fail-safe back-up method for deflating the packer(s).

During packer inflation, pressurized drilling mud flows through the deflate sub via inflation channels 576 in stinger adaptor 572, fluid passageways 598 in top connector 578, fluid passageways 604 in middle connector 602, fluid passageways 612 in collar 608, and fluid passageway 626 between outer stinger 614 and bottom connector 606, from the pump subassembly 104 to the packer(s).

The packer deflate subassembly 110 is preferably designed so that pulling on the drill string, in the case of a deflate malfunction in the valve subassembly 108, will cause tension sleeve 600 to break at a predetermined tension value. This tension value can be controlled by the depth of the groove illustrated at its central portion in FIG. 1B and will be greater than that normally required to elongate or stretch the valve subassembly 108.

When tension sleeve 600 breaks, top sub 570 and retrieving sleeve 586 will be pulled upwardly until shoulder 588 on the retrieving sleeve 586 abuts the lower face of collar 582 on top connector 578 and dogs 590 snap into detents 584.

At this point, the O-ring carried by retrieving sleeve 586 no longer forms a seal against collar 582 on the top connector 578. Deflate ports 596 in the retrieving sleeve 586 will have passed above the collar 582 and be in fluid communication with packer inflation fluid in the passageways 576, etc. Packer inflation fluid is thus vented to the well annulus, thereby allowing the packer(s) to deflate.

If dual packers are used in the testing tool, by-pass orifice 634 in middle connector 602 can be employed for equalizing well pressure below the lower packer and above the upper packer. In the case of a single packer test, plugs are preferably threaded into by-pass orifices 634.

Having now reviewed this Detailed Description and the illustrations of the presently preferred embodiment of this invention, those skilled in the art will realize that the invention may be employed in a substantial number of alternate embodiments. Even though such embodiments may not even appear to resemble the preferred embodiment, they shall nevertheless employ the invention as set forth in the following claims.

We claim:

1. An emergency deflation mechanism intended for use in an inflatable packer system adapted for use in a well annulus comprising:

a longitudinally extending fixed cylindrical member adapted to be fixed against axial movement when in position in a well annulus;

a slidably movable cylindrical member, said slidably movable cylindrical member being adapted for relative movement axially with respect to said fixed cylindrical member;

inflation fluid passage means;

a circumferentially grooved tension sleeve joining said fixed cylindrical member and said slidably movable cylindrical member and adapted to be ruptured when a predetermined tension is applied to said slidably movable cylindrical member;

so that said slidably movable cylindrical member moves axially with respect to said fixed cylindrical member to vent inflation fluid from said inflation fluid passage means to the well annulus.

2. An emergency deflation mechanism intended for use in an inflatable packer system adapted for use in a well annulus comprising:

a longitudinally extending fixed cylindrical member adapted to be fixed against axial movement when in position in a well annulus;

a slidably movable cylindrical member surrounding a portion of the length of said fixed cylindrical member, said slidably movable cylindrical member being adapted for relative movement axially with respect to said fixed cylindrical member;

inflation fluid passage means;

a circumferentially grooved tension sleeve joining said fixed cylindrical member and said slidably movable cylindrical member and adapted to be ruptured when a predetermined upward tension is applied to said slidably movable cylindrical member;

so that said slidably movable cylindrical member moves axially with respect to said fixed cylindrical member to vent inflation fluid from said inflation fluid passage means to the well annulus.

3. The emergency deflation mechanism of claim 2, wherein said tension sleeve has internally threaded upper and lower ends, said upper internally threaded end being threadedly connected to said fixed cylindrical member; and wherein said tension sleeve has internal and external circumferential grooves located between said threaded upper and lower ends, the depth of said grooves determining said predetermined rupture tension.

4. An emergency deflation mechanism intended for use in an inflatable packer system adapted for use in a well annulus, comprising:

a longitudinally extending fixed cylindrical member adapted to be fixed against axial movement when in position in a well annulus;

a slidably movable cylindrical member surrounding a portion of the length of said fixed cylindrical member, said slidably movable cylindrical member being adapted for relative movement axially with respect to said fixed cylindrical member;

inflation fluid passage means;

a circumferentially grooved tension sleeve joining said fixed cylindrical member and said slidably movable cylindrical member and adapted to be ruptured when a predetermined upward tension is applied to said slidably movable cylindrical member; and vent means in said slidably movable cylindrical member adapted to be placed in fluid communication with said inflation fluid passage means when said slidably movable member moves axially with respect to said fixed cylindrical member, thereby venting inflation fluid from said inflation fluid passage means to the well annulus.

5. An emergency deflation mechanism intended for use in an inflatable packer system and adapted for use in a well annulus comprising:

a longitudinally extending fixed cylindrical member adapted to be fixed against axial movment when in position in a well annulus;

a slidably movable cylindrical member, said slidably movable cylindrical member being adapted for relative movement axially with respect to said fixed cylindrical member;

inflation fluid passage means;

a circumferentially grooved tension sleeve joining said fixed cylindrical member and said slidably movable cylindrical member and adapted to be ruptured when a predetermined tension is applied to said slidably movable cylindrical member;

so that said slidably movable cylindrical member moves axially with respect to said fixed cylindrical member to vent inflation fluid from said inflation fluid passage means to the well annulus;

stop means associated with said fixed cylindrical member and said slidably movable cylindrical member to limit at least one of axial and rotational movement of said slidably movable cylindrical member with respect to said fixed cylindrical member.

6. The emergency deflation mechanism of claim 5, wherein said portion of said fixed cylindrical member which is surrounded by said slidably movable cylindrical member has a detent formed in the exterior thereof, and wherein said slidably movable cylindrical member carries a spring loaded dog adapted to mate with said detent to limit further movement of said slidably movable cylindrical member with respect to said fixed cylindrical member.

7. An emergency deflation mechanism intended for use in an inflatable packer system adapted for use in a well annulus, comprising:

a longitudinally extending fixed cylindrical member having a lower end of relatively greater external diameter, an upper end of relatively lesser external diameter, and a shoulder formed at the juncture thereof, said fixed cylindrical member being adapted to be fixed against axial movement when in position in a well annulus;

a slidably movable cylindrical member surrounding a portion of said fixed cylindrical member upper end, said slidably movable cylindrical member being axially movable with respect to said upper end between a non-vented position in which said slidably movable cylindrical member contacts said shoulder in said fixed cylindrical member and a vented position;

an inflation fluid passage;

a circumferentially grooved tension sleeve connecting said fixed cylindrical member lower end and said slidably movable cylindrical member when said slidably movable cylindrical member is in said non-vented position and adapted to be ruptured when a predetermined upward tension is applied to said slidably movable cylindrical member; and said slidably movable cylindrical member having a vent port normally isolated with respect to said inflation fluid passage and adapted to be placed in fluid communication with said inflation fluid passage when said slidably movable member moves axially with respect to said fixed cylindrical member, thereby venting inflation fluid from said inflation fluid passage to the well annulus.

* * * * *